US006213545B1

(12) United States Patent
Chun-Yueh

(10) Patent No.: US 6,213,545 B1
(45) Date of Patent: Apr. 10, 2001

(54) FOLDABLE CHAIR

(76) Inventor: Wang Lo Chun-Yueh, P.O. Box 24-108, Taipei (TW)

( * ) Notice: Subject to any disclaimer, the term of this patent is extended or adjusted under 35 U.S.C. 154(b) by 0 days.

(21) Appl. No.: 09/627,182

(22) Filed: Jul. 27, 2000

(51) Int. Cl.[7] ..... A47C 4/20
(52) U.S. Cl. ..... 297/39
(58) Field of Search ..... 297/16.1, 35, 39, 297/40

(56) References Cited

U.S. PATENT DOCUMENTS 2,284,498 * 5/1942 Tucker ..... 297/39
2,906,319 * 9/1959 Goldstein ..... 297/39
3,279,734 * 10/1966 Kramer ..... 297/39 X
4,536,026 * 8/1985 Cornell ..... 297/39
5,054,848 * 10/1991 Liu ..... 297/39

* cited by examiner

*Primary Examiner*—Peter R. Brown

(57) ABSTRACT

An improved foldable chair having a seat and a backrest that can be folded in a linking-up movement includes front and rear leg supports that are spaced apart with the front leg support on the inside, the rear leg support on the outside. The front and rear leg supports are pivotally connected to elbow rests. A middle section of the rear leg support is pivotally connected to a connecting plate having a wider upper portion and a narrower lower portion. The inner side of the connecting plate extends upwardly to form opposite spaced apart N-shaped bends, and is pivotally connected to outer sides of tail ends of the seat and the backrest. During folding of the chair, the front leg support may be folded in the inwardly recessed space of the connecting plate to form a substantially planar surface. Hence, the front and rear leg supports will not be in a stacked manner to occupy much space, and storage and transport costs can be reduced.

1 Claim, 5 Drawing Sheets

FOLDABLE CHAIR

BACKGROUND OF THE INVENTION (a) Field of the Invention

The present invention relates to a foldable chair, more particularly to an improved foldable chair having a seat and a backrest that can be folded in a linking-up movement includes front and rear leg supports that are spaced apart with the front leg support on the inside, the rear leg support on the outside. The front and rear leg supports are pivotally connected to elbow rests. A middle section of the rear leg support is pivotally connected to a connecting plate having a wider upper portion and a narrower lower portion. The inner side of the connecting plate extends upwardly to form opposite spaced apart N-shaped bends, and is pivotally connected to outer sides of tail ends of the seat and the backrest. During folding of the chair, the front leg support may be folded in the inwardly recessed space of the connecting plate to form a substantially planar surface. Hence, the front and rear leg supports will not be in a stacked manner to occupy much space, and storage and transport costs can be reduced.

(b) Description of the Prior Art

Furniture items are generally bulky and occupy a lot of space. Therefore, manufacturers have developed modular and foldable furniture items. FIG. 5 shows a conventional foldable chair, which is adapted for use in yards or gardens. The conventional foldable chair has front and rear legs that are pivotally connected to elbow rests in an aligned arrangement. As such, during folding of the chair, the front and rear legs will be in a stacked manner, which will increase the thickness of the folded chair and hence storage and transport costs.

SUMMARY OF THE INVENTION

Therefore, the main object of the present invention is to provide an improved foldable chair in which the seat and backrest can be folded in a linking-up movement, and the front and rear leg supports are spaced apart with the front lea support on the inside, the rear leg support on the outside. The front and rear leg supports are pivotally connected to elbow rests. A middle section of the rear leg support is pivotally connected to a connecting plate having a wider upper portion and a narrower lower portion. The inner side of the connecting plate extends upwardly to form opposite spaced apart N-shaped bends, and is pivotally connected to outer sides of tail ends of the seat and the backrest. By means of this arrangement, during folding of the chair, the front leg support may be folded in the inwardly recessed space of the connecting plate to form a substantially planar surface. Hence, the front and rear leg supports will not be in a stacked manner to occupy much space, and storage and transport costs can be reduced.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
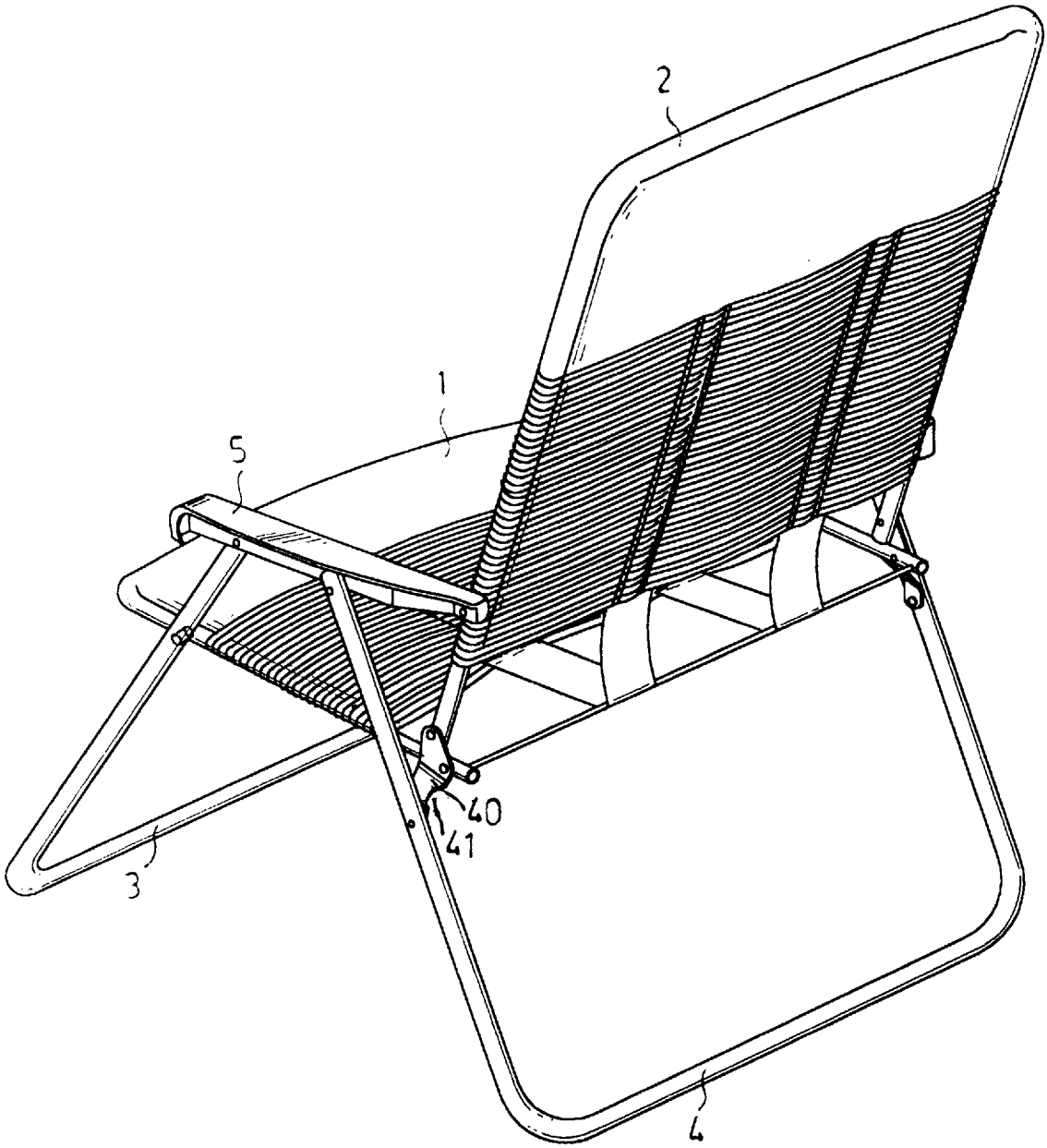
FIG. 1 is a perspective view of a preferred embodiment of the present invention.
Figure 2:
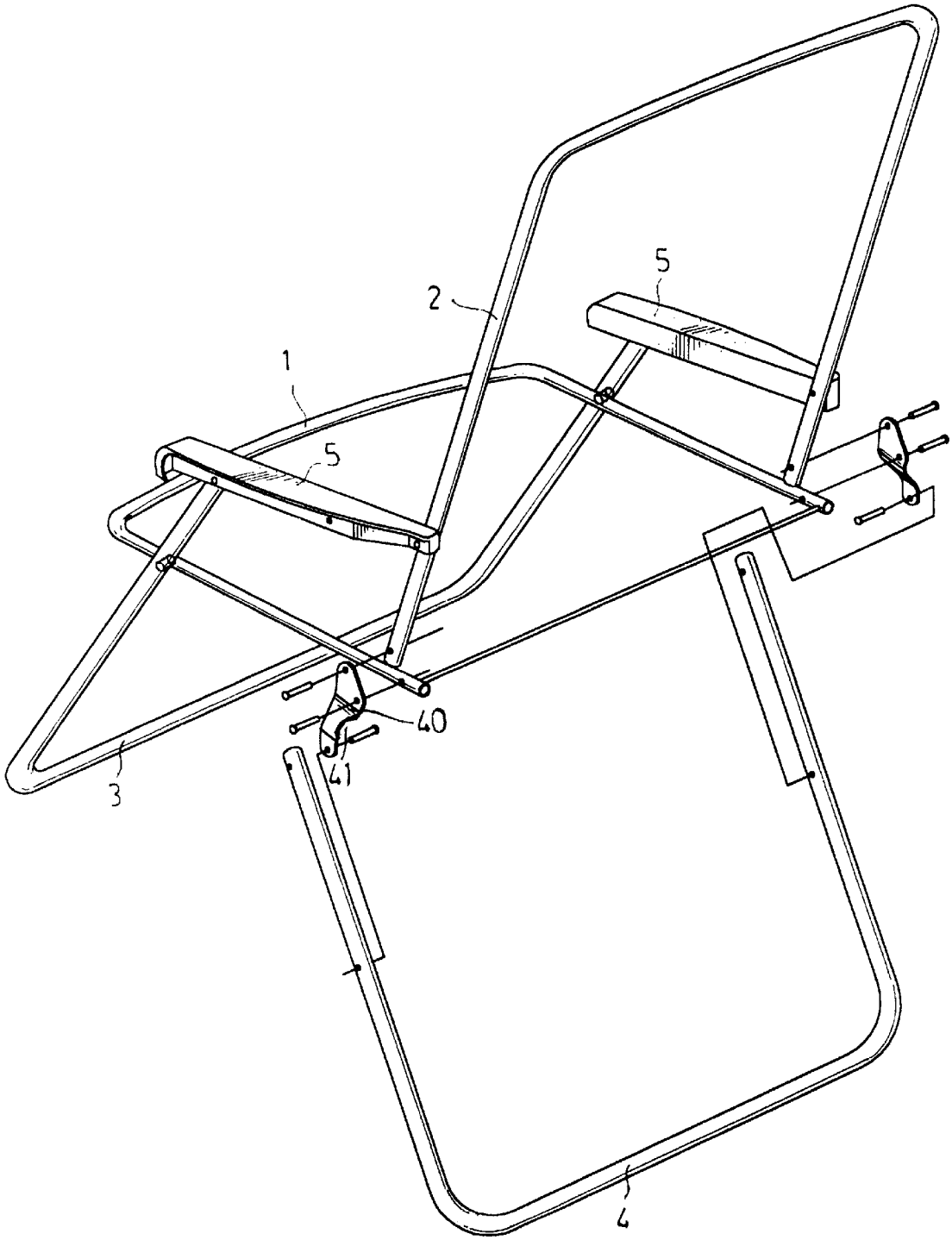
FIG. 2 is a partly exploded perspective view of the preferred embodiment present invention.
Figure 3:
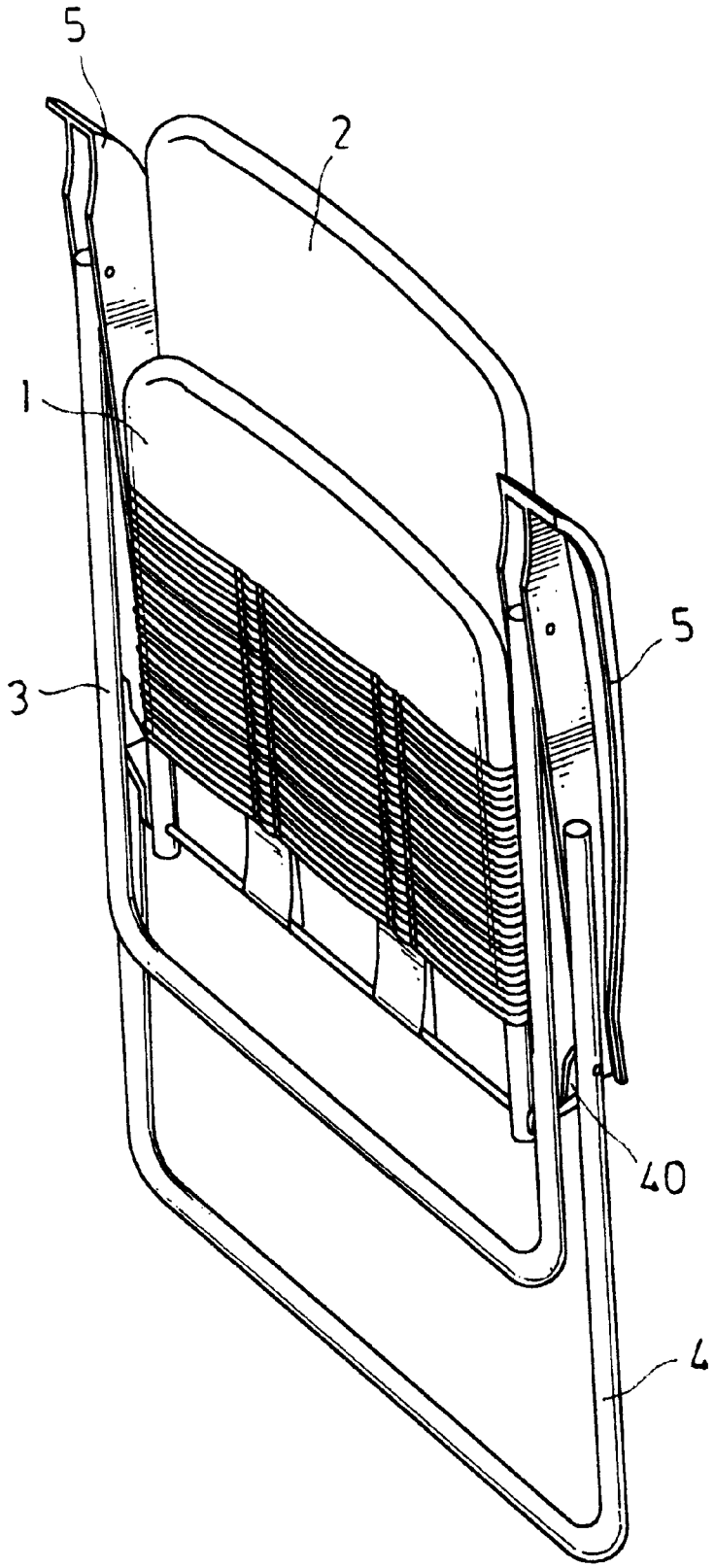
FIG. 3 is a perspective view of the preferred embodiment of the present invention in a folded state.
Figure 4:
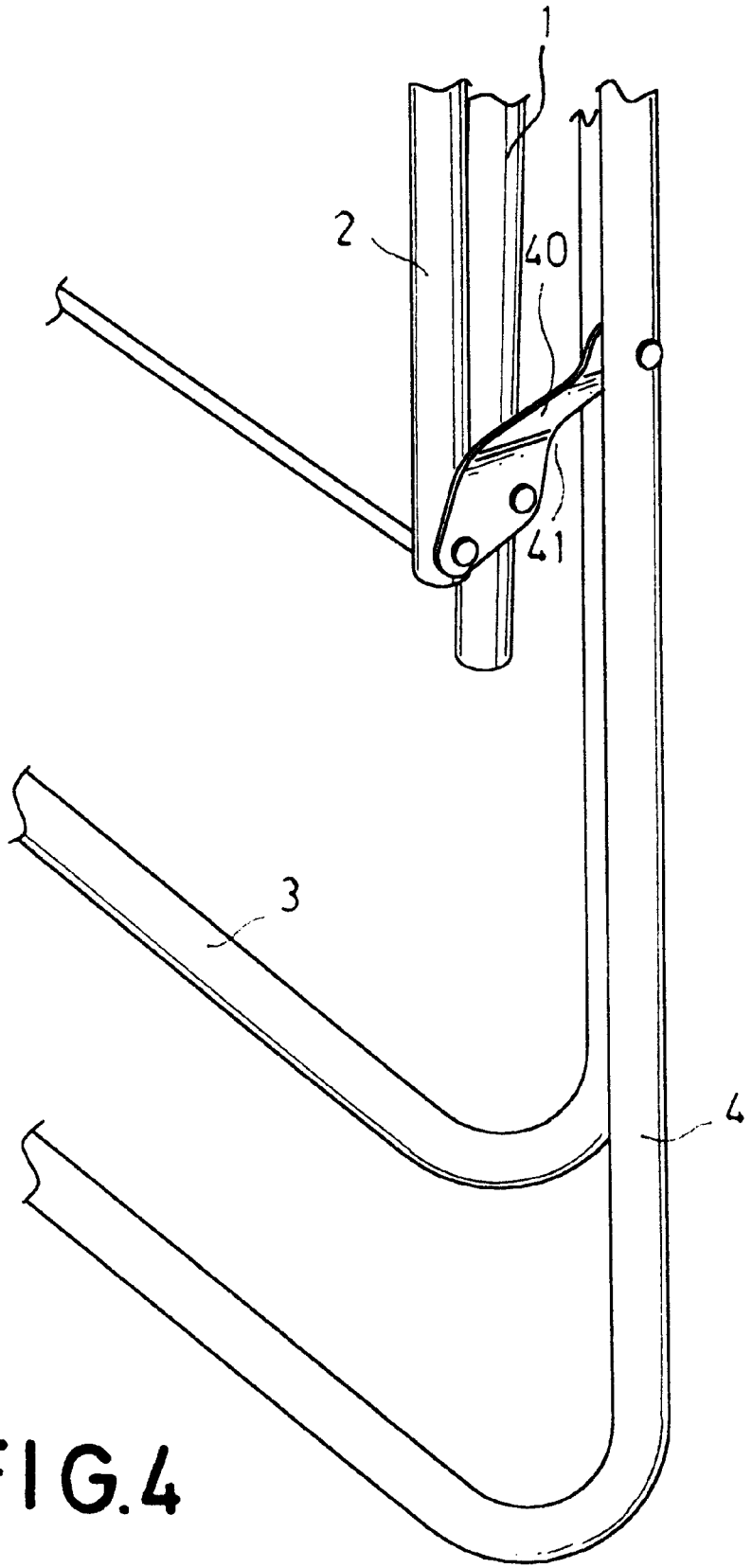
FIG. 4 is a fragmentary perspective view of the preferred embodiment in the folded state.
Figure 5:
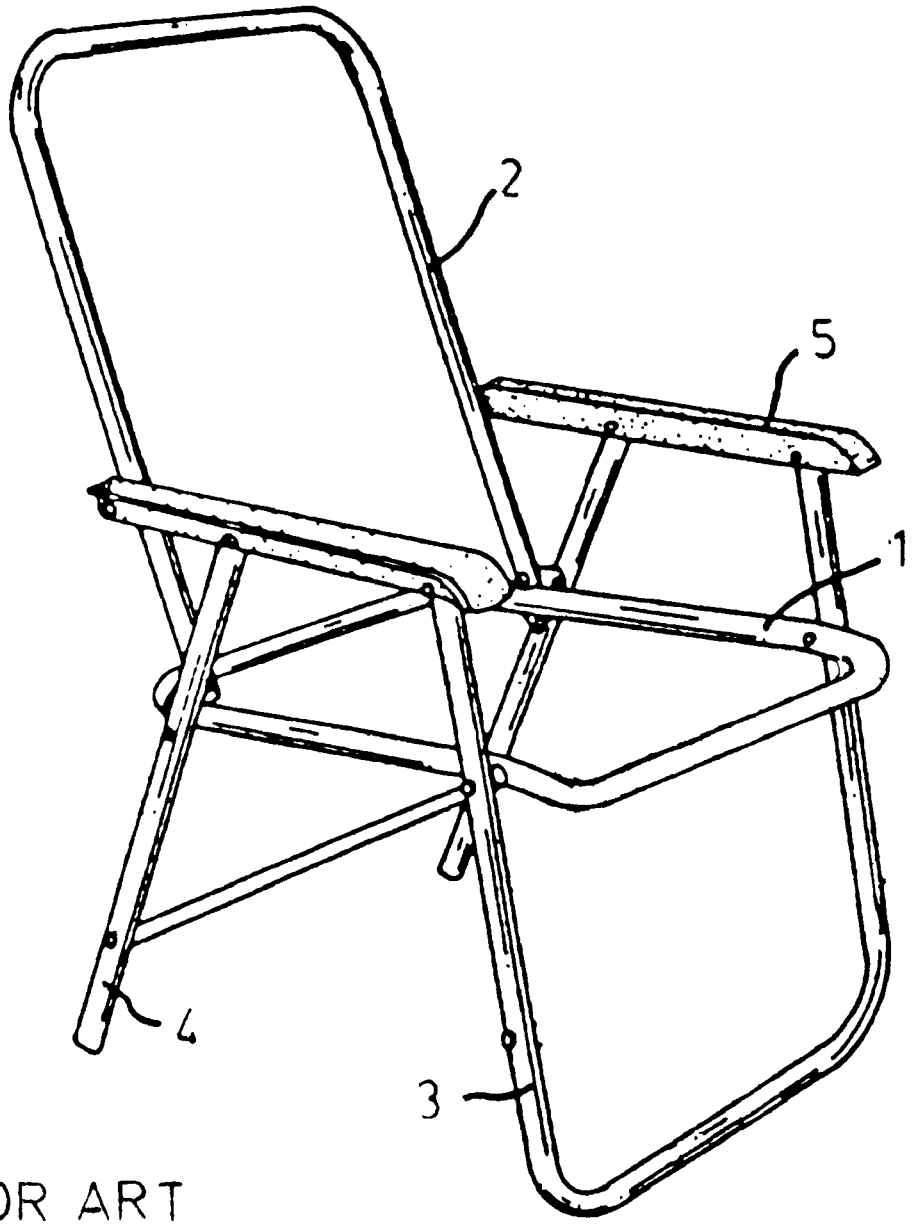
PRIOR ART FIG.5
FIG. 5 is a perspective view of the prior art.

With reference to FIGS. 1 to 4, the improved foldable chair of the present invention includes a seat 1, a backrest 2, a front leg support 3, a rear leg support 4, and elbow rests 5. The seat 1 and the backrest 2 are pivotally connected at end portions thereof in a known manner such that they are adjustable relative to each other. The middle section of each of the left and right sides of the backrest 2 is pivotally connected to the tail end of the elbow rest 5. The middle section of each elbow rest 5 is connected to the front and rear leg supports 3, 4, which are spaced apart from each other, with the front leg support 3 on the inside, the rear leg support 4 on the outside. The middle section of the rear leg support 4 is pivotally connected to a connecting plate 40 which has a wider upper portion and a narrower lower portion, with inwardly recessed edges 41. The inner side of the connecting plate 4 extends upwardly to form opposite spaced-apart N-shaped bends, with an upper end pivotally connected to the outer sides of the tail ends of the seat 1 and the backrest 2, respectively. The left and right portions of the front leg support 3 and the rear leg support 4 are connected via links 6 to prevent distortion.

In use, the user only needs to stretch the seat 1 and the backrest 2 to cause the front leg support 3, the rear leg support 4, and the elbow rests 5 to extend to form a chair. To fold the chair, the seat 1 and the backrest 2 are brought towards each other, so that the front leg support 3, the rear leg support 4, along with the elbow rests 5 are folded. Since the front and rear leg supports 3, 4 are arranged in a spaced apart relationship, with the front leg support 3 on the inside, the rear leg support 4 on the outside, and since the connecting plate 4 is configured to have a wide upper portion and a narrower lower portion, and is spaced apart from the front and rear legs 3, 4, the front leg support 3 can be folded in the inwardly recessed edges 41 of the connecting plates 40 between the rear leg support 4 and the seat 1 and the backrest 2 to thereby achieve a substantially planar surface when the chair is folded. Hence, the folded chair will not occupy a lot of space and will reduce storage and transport costs.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved foldable chair, comprising:

a seat which is a seat frame adapted for sitting by a user;

a backrest which is a backrest frame adapted for reclining by the user; elbow rests, each of which has a tail end pivotally connected to a middle section of each of left and right sides of said backrest, a middle section thereof being pivotally connected to front and rear leg supports, and being adapted for resting of the user's elbows, wherein said middle section of each of said elbows is pivotally connected to said front and rear leg supports in such a manner that said front and rear leg supports are spaced apart, with said front leg support on the inside, said rear leg support on the outside, said front leg support having a middle section pivotally connected to said seat, said rear leg support having a middle section pivotally connected to a connecting plate having a wider upper portion and a narrower lower portion and forming inwardly recessed edges, said connecting plate having an inner side extending upwardly to form opposite spaced apart N-shaped bends, with upper ends pivotally connected to outer sides of tail ends of said seat and said backrest.

* * * * *